US008710430B2

(12) United States Patent
Sugiyama et al.

(10) Patent No.: US 8,710,430 B2
(45) Date of Patent: Apr. 29, 2014

(54) MASS SPECTROMETRY METHOD

(75) Inventors: Masuyuki Sugiyama, Hino (JP); Yuichiro Hashimoto, Tachikawa (JP); Shun Kumano, Kokubunji (JP); Yohei Kawaguchi, Hachioji (JP); Hidetoshi Morokuma, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 126 days.

(21) Appl. No.: 13/527,619

(22) Filed: Jun. 20, 2012

(65) Prior Publication Data

US 2012/0326027 A1 Dec. 27, 2012

(30) Foreign Application Priority Data

Jun. 24, 2011 (JP) ..... 2011-140089

(51) Int. Cl.
*H01J 49/42* (2006.01)
*H01J 49/26* (2006.01)
*H01J 49/00* (2006.01)

(52) U.S. Cl.
USPC ..... 250/283; 250/290; 250/293

(58) Field of Classification Search
USPC ..... 250/281–283, 286–288, 290–293, 299, 250/423 R, 526
See application file for complete search history.

(56) References Cited

U.S. PATENT DOCUMENTS

| | | | | |
|---|---|---|---|---|
| 5,206,509 | A * | 4/1993 | McLuckey et al. | 250/292 |
| 5,572,022 | A | 11/1996 | Schwartz et al. | |
| 6,787,760 | B2 * | 9/2004 | Belov et al. | 250/282 |
| 6,884,996 | B2 | 4/2005 | Senko | |
| 7,800,058 | B2 * | 9/2010 | Sugiyama et al. | 250/292 |
| 7,820,961 | B2 * | 10/2010 | Hashimoto et al. | 250/281 |
| 2003/0071206 | A1 * | 4/2003 | Belov et al. | 250/282 |
| 2006/0289743 | A1 | 12/2006 | Hasegawa et al. | |
| 2007/0084998 | A1 * | 4/2007 | Franzen et al. | 250/287 |
| 2008/0116372 | A1 * | 5/2008 | Hashimoto et al. | 250/292 |
| 2009/0302215 | A1 * | 12/2009 | Guna et al. | 250/283 |
| 2012/0091334 | A1 * | 4/2012 | Guna | 250/283 |
| 2012/0112059 | A1 * | 5/2012 | Sugiyama et al. | 250/282 |

* cited by examiner

*Primary Examiner* — Bernard E Souw
(74) *Attorney, Agent, or Firm* — Antonelli, Terry, Stout & Kraus, LLP.

(57) ABSTRACT

A mass spectrometry method that corrects the effects from space charge and that achieves both sensitivity and a dynamic range. The mass axis of the mass spectrum is corrected based on the counts of ions accumulated within the ion trap at the point in time each ion was extracted.

8 Claims, 16 Drawing Sheets

FIG. 14

| | MASS m/z | THRESHOLD OF ION SIGNAL OF SAMPLE ION | MS/MS YES/NO | PRECURSOR ION OF MS/MS m/z | FRAGMENT IONS OF MS/MS m/z | THRESHOLD OF MS/MS ION SIGNAL INTENSITY OF SAMPLE ION |
|---|---|---|---|---|---|---|
| SAMPLE COMPOUND A | $m_{a1}$<br>$m_{a2}$<br>$m_{a3}$ | $I_{a1}$<br>$I_{a2}$<br>$I_{a3}$ | NO | | | |
| SAMPLE COMPOUND B | $m_{b1}$ | $I_{b1}$ | YES | $m_{b1}$ | $m_{b1}'$<br>$m_{b2}'$ | $I_{b1}'$<br>$I_{b2}'$ |
| SAMPLE COMPOUND C | $m_{c1}$<br>$m_{c2}$<br>$m_{c3}$ | $I_{c1}$<br>$I_{c2}$<br>$I_{c3}$ | YES | $m_{c1}$ | $m_{c1}'$ | $I_{c1}'$ |
| ⋮ | ⋮ | ⋮ | ⋮ | ⋮ | ⋮ | ⋮ |

MASS SPECTROMETRY METHOD

CLAIM OF PRIORITY

The present application claims priority from Japanese patent application JP 2011-140089 filed on Jun. 24, 2011, the content of which is hereby incorporated by reference into this application.

BACKGROUND

The present invention relates to a mass spectrometer and a mass spectrometry method utilized in that mass spectrometer.

In mass spectrometry utilizing an ion trap by the method disclosed in U.S. Pat. No. 5,572,022, the total counts of ions extracted from the ion trap is first measured, and based on that information the total counts of ions introduced to the ion trap is regulated and mass spectrometry performed under conditions where there is minimal effect from space charge.

U.S. Pat. No. 6,884,996 discloses a method for performing high efficiency mass spectrometry or mass spectrometry analysis by compensating for the shift in resonant frequency occurring due to space charge at the resonant frequency utilized for isolating the precursor ion and dissociation during tandem mass spectrometry analysis. In this method, the quantity of trapped ions is estimated from the time that the ions were introduced into the ion trap, and the shift in resonant frequency due to the space charge then calculated from that ion counts.

United States Patent Publication No. 2006/0289743 discloses a method for compensating for the mass shift due to space charge by finding the total ion counts on the mass spectrum.

SUMMARY

The present invention achieves both a satisfactory sensitivity and dynamic range during mass spectrometric analysis by correcting for effects from space charge when performing spectrometric analysis with an ion trap.

The method of U.S. Pat. No. 5,572,022 has the problem of low sensitivity because the quantity of ions introduced to the ion trap is regulated to a quantity whose space charge effect is small. This problem is particularly evident when ion species in extremely large quantities are present while mixed with ion species present in small quantities because the quantity of ions introduced to the ion trap is regulated to avoid effects from space charge of ion species in extremely large quantities so that measuring ion species present in small quantities is difficult. Moreover, when there is a time fluctuation in the counts of ions introduced to the ion trap, then effects from space charge are unavoidable because the timing of the counts of ions introduced when measuring the total ion counts is different from the timing of the counts of ions introduced during mass spectrometric analysis.

The method of U.S. Pat. No. 6,884,996 only discloses a frequency for an AC voltage utilized for dissociating the ions during tandem mass spectrometric analysis and does not give any description of methods for correcting the shift in the mass spectrum due to the space charge. Moreover if there is a time function in the counts of ions introduced to the ion trap, then the timing of the counts of ions introduced when measuring the total ion counts will differ from the timing of the counts of ions introduced during mass spectrometric analysis so that effects from space charge are sometimes unavoidable.

The method of United States Patent Publication No. 2006/0289743 corrects all peaks in the mass spectrum from the total ion counts. Therefore, the method of United States Patent Publication No. 2006/0289743 is incapable of correcting effects from fluctuating ion quantities due to ions sequentially extracted during the period that the ion spectrum was measured, and the accuracy when correcting the space charge effects is small.

The mass spectrum axis is corrected based on the counts of ions accumulated within the ion trap at the point in time that each ion is extracted.

The present invention is capable of correcting the effects from space charge when performing mass spectrometry with an ion trap to achieve both a satisfactory sensitivity and dynamic range.

BRIEF DESCRIPTION OF THE DRAWINGS

FIG. 14 is a drawing showing a list of the m/z (molecular mass to elementary charges of the ion) of the ions of the object for measurement and the ion signal intensity threshold values;

DETAILED DESCRIPTION

First Embodiment

Figure 1A:
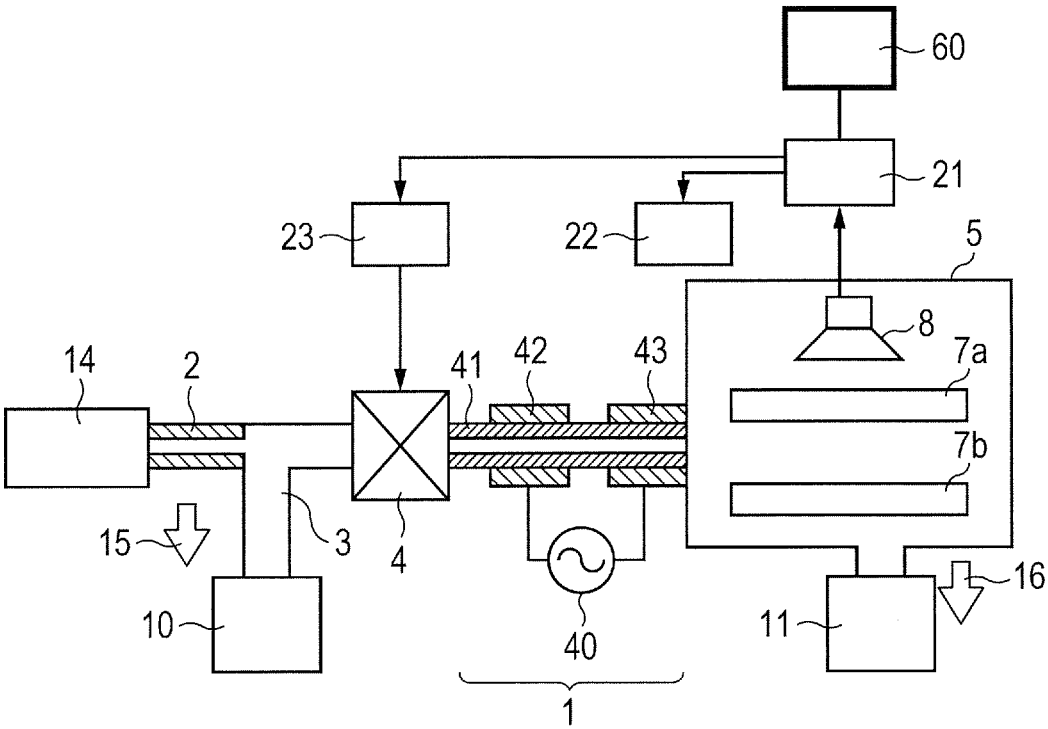
FIGS. 1A and 1B are pictorial block diagrams showing one example of the mass spectrometer.
Figure 1B:
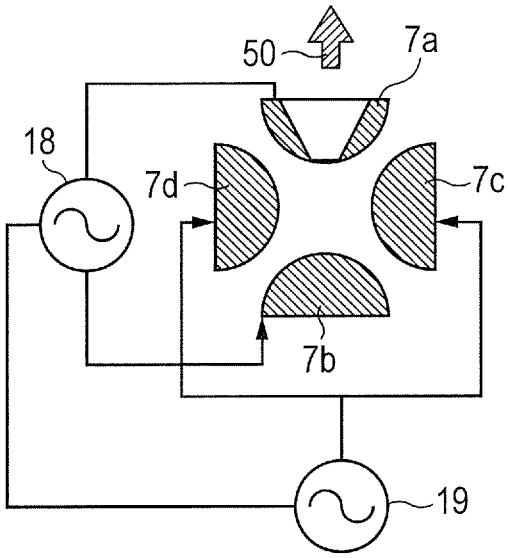

FIGS. 1A and 1B are pictorial block diagrams showing one example of the mass spectrometer. A vaporizer part 14 comprised of a heater or spray atomizer vaporizes a portion of the sample and supplies the vaporized portion by way of a capillary 2 to a valve pre-exhaust region 3. An exhaust pump 10 exhausts (evacuates) the valve pre-exhaust region 3. The exhaust direction of this exhaust pump is indicated as the reference numeral 15.)

The vaporized sample is introduced into the valve pre-exhaust region 3, and when the valve 4 opens, is introduced along with the surrounding gas to a dielectric capillary 41 comprised of a dielectric such as glass, ceramic, or plastic, etc. An electrode 42 and an electrode 43 are mounted on the outer side of the dielectric, and a power supply 40 applies a voltage of approximately 2 to 5 kilovolts at a frequency from 1 to 100 kHz across the electrode 42 and electrode 43 to cause a dielectric barrier discharge to develop. Introducing the vaporized molecules into this discharge region generates ions from the sample molecules. The valve 4 is structured by way of a slide valve or pinch valve as well as other described schemes in order to discontinuously regulate the inflow or non-inflow of gas. The ions generated in the dielectric capillary 41 are introduced to amass analyzing chamber 5 where a mass spectrometry part 7 and a detector part 8 are mounted. An exhaust pump 11 such as a turbo-molecular pump or an ion getter pump evacuates the mass analyzing chamber 5 (the exhaust) direction of this exhaust pump is indicated by the reference numeral 16). The example in FIG. 1(A) showed the valve 4 and the mass analyzing chamber 5; as well as the valve 4 and the vaporizer part 14 coupled by a capillary, however an orifice may be utilized instead of the capillary.

The ions introduced into the mass analyzing chamber 5 are then introduced into the mass spectrometry part 7. In the example of the first embodiment, a linear ion trap mass spectrometer is utilized for describing the measurement sequence. This linear ion trap mass spectrometer is comprised of multiple electrodes, for example of four piece quadrupole rod electrodes (7*a*, 7*b*, 7*c*, and 7*d*). A trap RF voltage 19 is applied to these quadrupole rod electrodes in the same phase to the opposite-facing rods (between 7*a* and 7*b* and between 7*c* and 7*d*), and in the opposite phase for adjacent rods. The trap RF voltage 19 is known to have different optimal values due to the electrode size and measurement mass range, and typically has an amplitude of 0 to 5 kilovolts (0-peak) and utilizes a frequency of approximately 500 kilohertz to 5 megahertz. Moreover, in addition to the trap RF voltage 19, a positive offset voltage may be applied when measuring positive ions and a negative offset voltage may be applied when measuring negative ions. Applying the trap RF voltage 19 forms a pseudopotential, that traps ions within the space inside the quadrupole rod electrodes 7.

An supplemental AC voltage 18 is superimposed across the pair of opposite-facing electrodes (between 7*a*, 7*b*). The supplemental AC voltage 18 is typically a multiplexed waveform holding plural frequency components and a single frequency of approximately 5 kHz to 2 MHz and an amplitude of 0 to 50 volts (0-peak). Applying this supplemental AC voltage 18 allows mass scan of ions trapped in the quadrupole rod electrodes 7, selecting just the ion of the designated m/z and ejecting all others, dissociating ions of the designated m/z, and selectively scanning by mass to eject ions. The method described here for mass scan is applying the supplemental AC voltage 18 across the pair of electrodes, however there are also other methods such as applying an auxiliary alternating current (AC) voltage in the same phase across the pair of rod electrodes (between 7*a*, 7*b*). The ions mass selectively extracted (ejection direction shown by the reference numeral 50) are converted to an electrical signal by the detector part 8 configured for example from an electron multiplier and a multichannel plate and are sent to the control part 21. In the control part 21, the output signals from the detector part 8 are converted into digital data in the analog-digital converter (ADC) and pulse counting part at each fixed sampling period (typically 1 μs to 1000 μs) and accumulated within the storage part inside the control part.

This control part 21 includes a data processing part required for making spectrum corrections and located outside the storage part. The storage part is comprised from a memory and a hard disk and is capable of storing information such as the mass spectrum data, as well as numerals, relational expressions required for making corrections, and measurement sequences. The data processing part contains a memory for temporarily storing the required processing functions, and numerals required for processing. Aside from accumulating and converting the respective above information, the control part 21 includes a function for displaying information on the display part 60 and functions for controlling the valve power supply 23, and the control power supply 22 that regulates the electrodes, etc. The display part 60 is a display or printer and includes a function for displaying information such as the mass spectrum itself, or the peak m/z and intensity of the mass spectrum, and the presence or absence of the object for measurement.

The pressure in the mass analyzing chamber reaches 1 Pa or higher (typically in the vicinity of 10 Pa) when the valve 4 is open. On the other hand, the pressure for satisfactory operation of the detector part 8 comprised of a linear ion trap or electron multiplier is typically 0.1 Pa or less.

Figure 2:
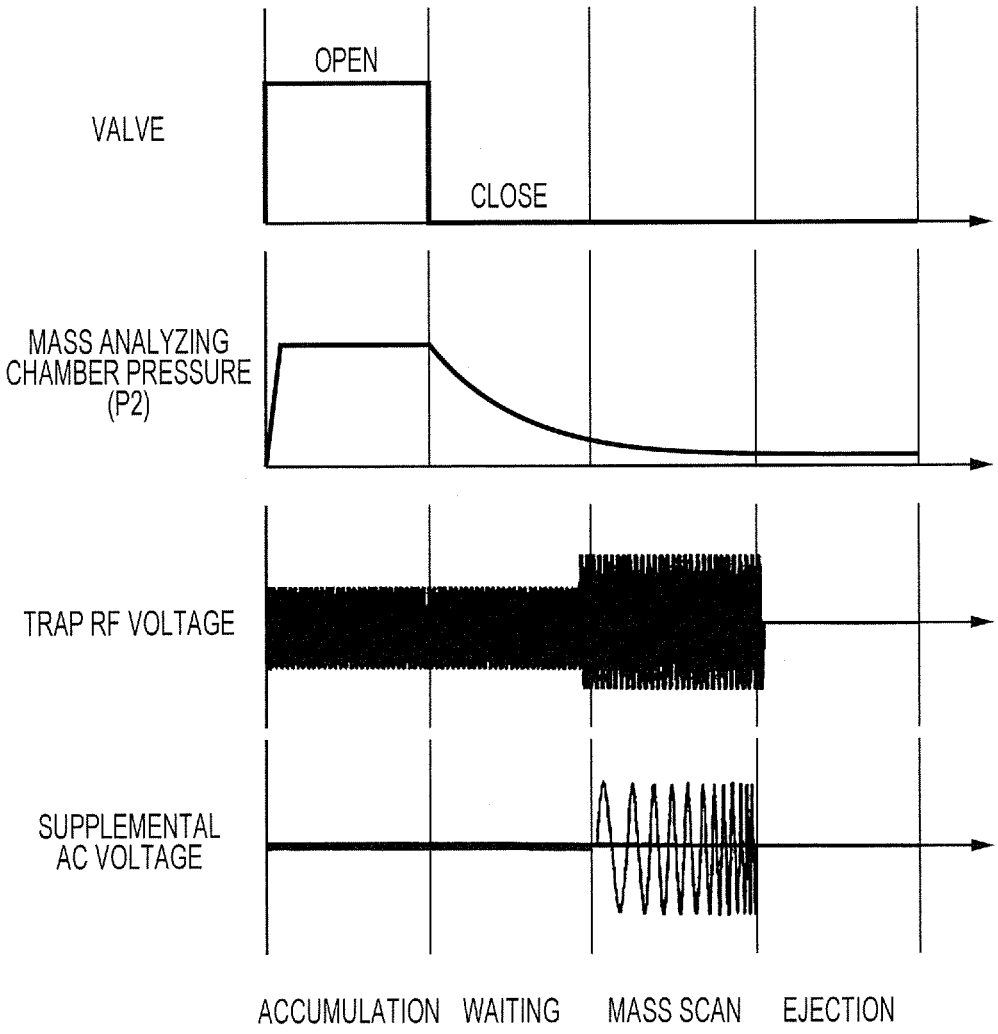
FIG. 2 is a graph showing the measurement sequence.

FIG. 2 is a graph showing the measurement sequence. This measurement sequence is comprised of the four processes of accumulation, waiting, mass scan, and ejection.

In the accumulation process the valve 4 is opened and sample gas is introduced into the ionizing chamber 1, and the generated ions are trapped within the ion trap of the mass analyzing chamber 5.

In the waiting process, the operation is in standby (waiting period) until the pressure in the mass analyzing chamber 5 depressurizes to 0.1 Pa or lower, to allow ion measurement. In the accumulation process, the more the sample gas that is introduced, the greater the sensitivity but the waiting time becomes longer and the duty cycle decreases.

In the mass scan process, the ions are mass selectively extracted. The extracted ions are detected by the detector part 8 and the ion signal intensity is stored in the control part 21. The ions can be mass selectively extracted according to m/z by applying an supplemental AC voltage at the resonant frequency of the ions as shown in FIG. 2. The mass (kg) of the resonant excited singly charged ions is expressed by the following formula.

$$m = \frac{4eV}{qr_0^2\Omega^2} \quad \text{[Formula 1]}$$

Here, V denotes the trap RF voltage amplitude (V), Ω denotes the trap RF voltage angular frequency (rad/s), e denotes the elementary electrical charge, r0 denotes the quadrupole internal contact circle radius (m). Moreover q is a constant linking the constant β applied in the following (formula 2) with the relation in FIG. 3.

$$8 = \frac{2\omega}{\Omega} \quad \text{[Formula 2]}$$

Here, ω is the supplemental AC voltage angular frequency (rad/s). The m/z (molecular mass to elementary charges of the ion) of the resonant-excited ions is dependent on the q per (formula 1), the q is dependent on β per the relation in the figure, and β is dependent on ω per the relation in (formula 2). Therefore, the m/z of the resonant-excited ions can be scanned when scanning the frequency ω of the supplemental AC voltage from the start of scanning to a time t. This frequency ω may be scanned from the high frequency side to the low frequency side, or may be scanned from the low frequency side to the high frequency side. The mass spectrum can be obtained when plotting the signal intensity of the ions extracted from the ion trap as a function of the time from the start of scanning.

In the ejection process, the voltage amplitude of the trap RF voltage is set to 0, and all ions remaining within the trap are ejected.

Figure 4:
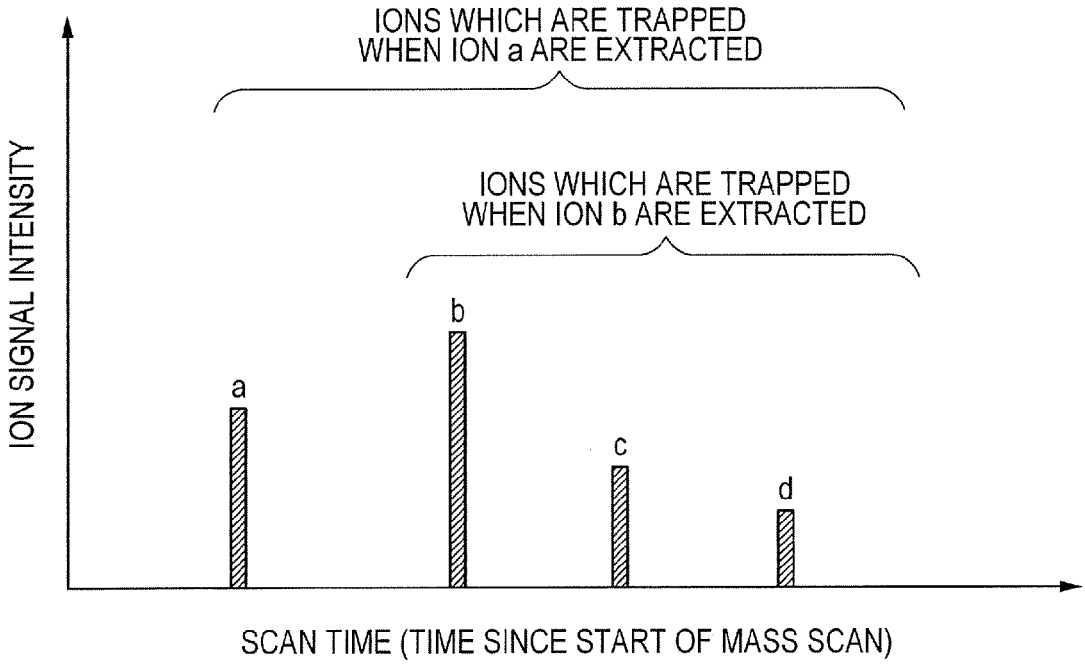
FIG. 4 is a diagram of the mass spectrum.

The difference between correcting the mass spectrum in this invention compared to when utilizing the total ion counts is first of all described. A diagram of the mass spectrum is shown in FIG. 4. The mass scan here is performed from low mass to high mass. The ions trapped at the point in time that ion a is extracted are the ions a, b, c, and d. On the other hand, the ions trapped at the point in time that ion b is extracted are the ions b, c, and d. When correcting by using the total ion counts, the correction is performed assuming that the total ion counts for all ions is within the trap. However, if for example the ion a was already extracted at the point in time that the ion b was extracted, then the counts of ions within the trap decreases, and the effect rendered by the space charge is reduced by an equivalent amount. A difference (or gap) therefore occurs due to the overcorrection when correcting the total ion counts relative to the peak of b. The present invention however finds the quantity of ions trapped at the point in time that the respective ion was extracted from the trap, and makes corrections using that quantity so that corrections are accurately performed.

Figure 5:
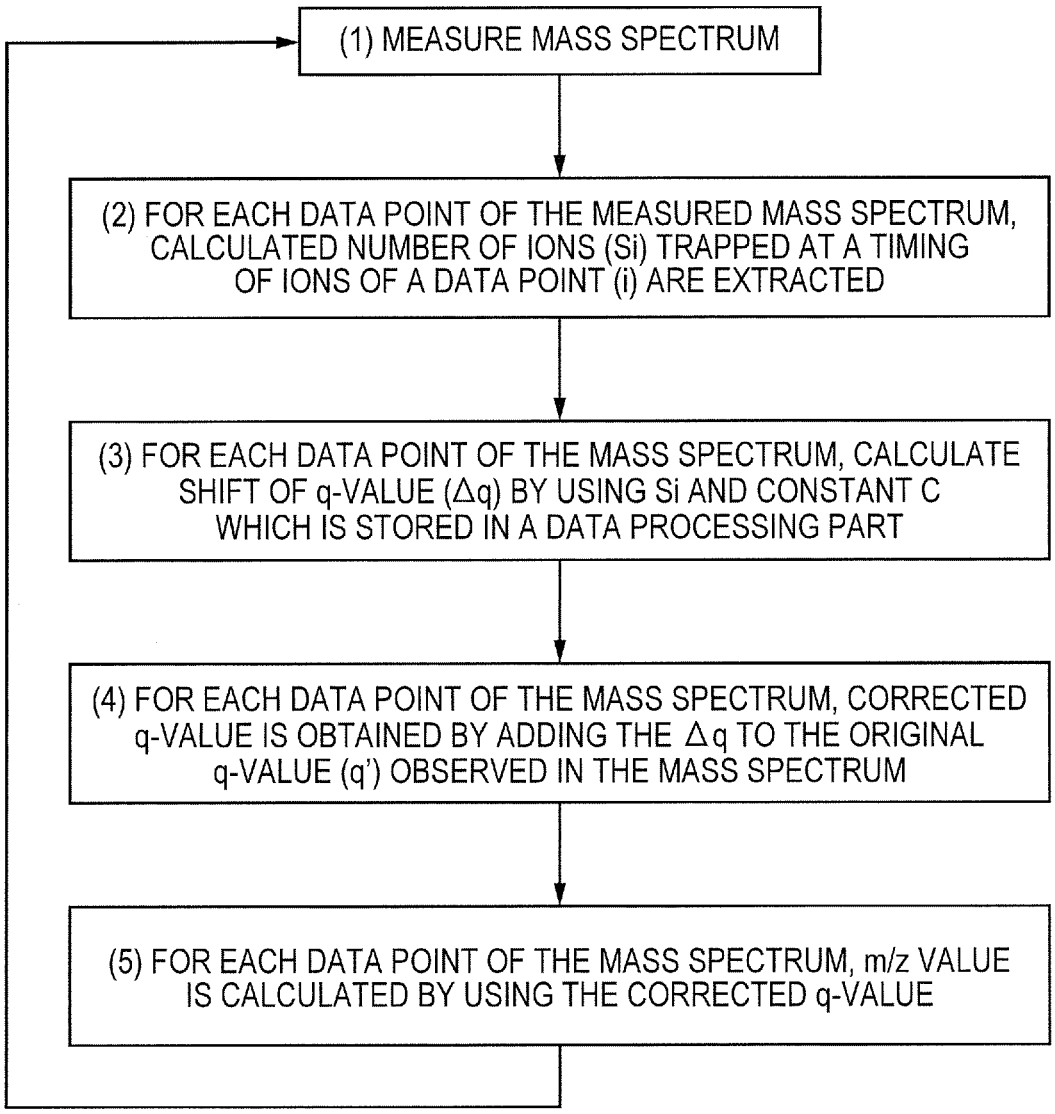
FIG. 5 is a flowchart for showing the specific method for achieving the present invention.
Figure 6:
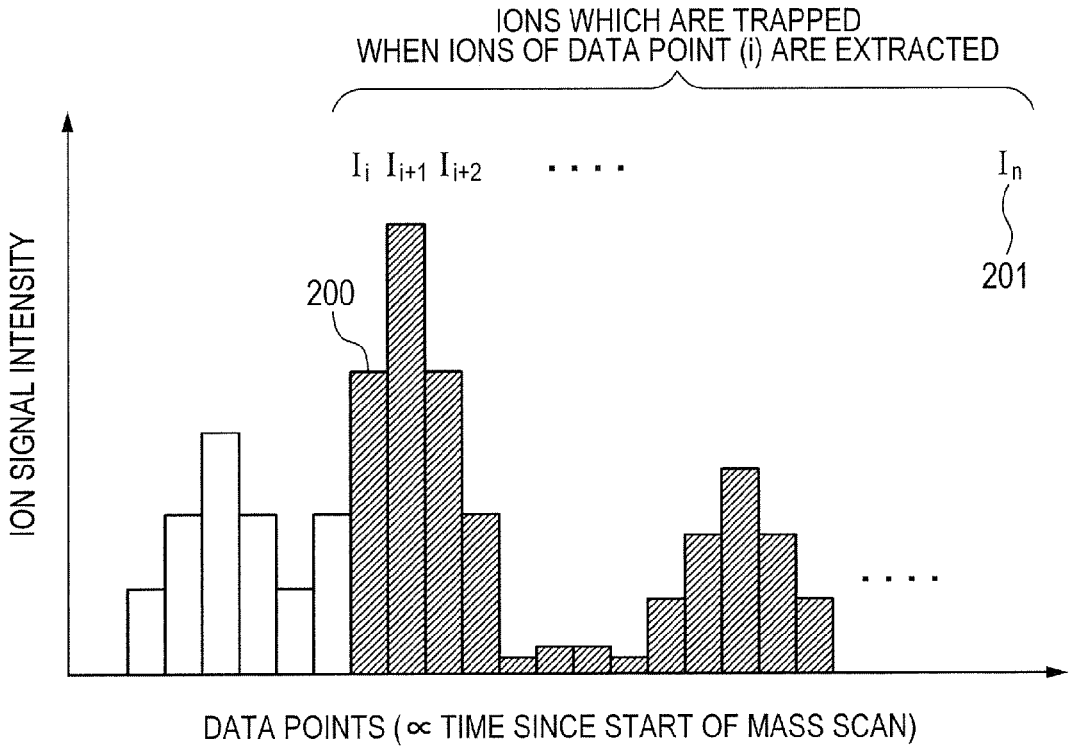
FIG. 6 is a drawing showing the ion signal intensity at each data point.

The specific method for making the correction is described next utilizing the flowchart in FIG. 5. The above described control part 21 makes the corrections. The mass spectrum measured for example by the measurement sequence in FIG. 2 is first of all obtained from the storage part. The mass spectrum is data arrayed along a time axis and is ion signal intensity values each acquired at sampling periods by the data processing part. FIG. 6 shows an example of the mass spectrum. Here, the horizontal axis is the time from the start of scanning and the vertical axis is the ion signal intensity. Ions extracted prior to the data point i, are shown by the white vertical bars, and ions extracted after the data point i are shown by the black vertical bars.

Next, the ion counts S at the point in time that ions were extracted at each data point is calculated for the mass spectrum stored in the data processing part. By integrating the ion signal intensity values for ions extracted after a point on the mass spectrum up to an end point on the mass spectrum, the counts of ions trapped at the point in time that the ion at that data point was extracted can be calculated. If for example the counts of ions trapped at the point in time that the ion extracted at data point i on the mass spectrum in FIG. 6 is set as Si, then the total sum of ions extracted after the data point shown by the black vertical bar is the Si.

Next the shift (Δq) in the q value from the trapped ion counts Si is calculated. Phenomenon such as a mass spectrum m/z shift due to a space charge can be handled as a fluctuation in the pseudopotential. The pseudopotential well of the linear ion trap is expressed by the following formula.

$$D = \frac{qV}{4} \quad \text{[Formula 3]}$$

Here, D denotes the height (V) of the pseudopotential well, and V denotes the trap RF voltage amplitude (V). Setting the change in pseudopotential well due to the space charge as ΔD, yields a relation between the pseudopotential well and the q value when there is a space charge effect that can be written as below.

$$D + \Delta D = (q + \Delta q)\frac{V}{4} \quad \text{[Formula 4]}$$

Substituting into (formula 3) yields the following.

$$\Delta D = \Delta q \frac{V}{4} \quad \text{[Formula 5]}$$

The value AD is proportional to the trapped ion counts and so the shift (Δqi) in the ion q value at data point i due to effects from the space charge is expressed by the following formula.

$$\Delta q_i = \frac{C}{V} S_i \quad \text{[Formula 6]}$$

Here, C is a constant established experientially and is dependent on the shape of the ion trap. This value C is stored within the data processing part or the storage part. The trap RF voltage amplitude V is a constant utilized when scanning the frequency of the supplemental AC voltage as in the present embodiment.

Figure 7:
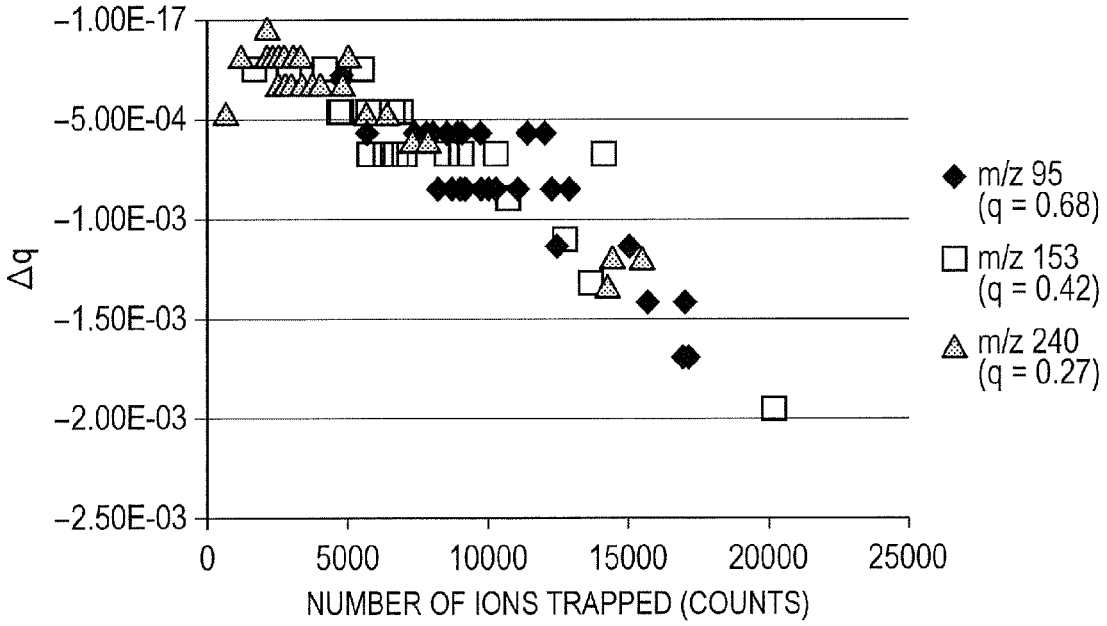
FIG. 7 is a graph showing the relation between the number of trapped ions and the shift in the q value.

FIG. 7 shows the experimental results from varying the counts of ions introduced to the trap, and measuring the shift in the q value of each ion at m/z 93, m/z 153, and m/z 240. The shift in the q value is proportional to the counts of ions trapped at the point in time that the ion was extracted, and rises in the same straight line regardless of m/z. These experimental results show that the relation in (formula 6) is definitely established.

Figure 3:
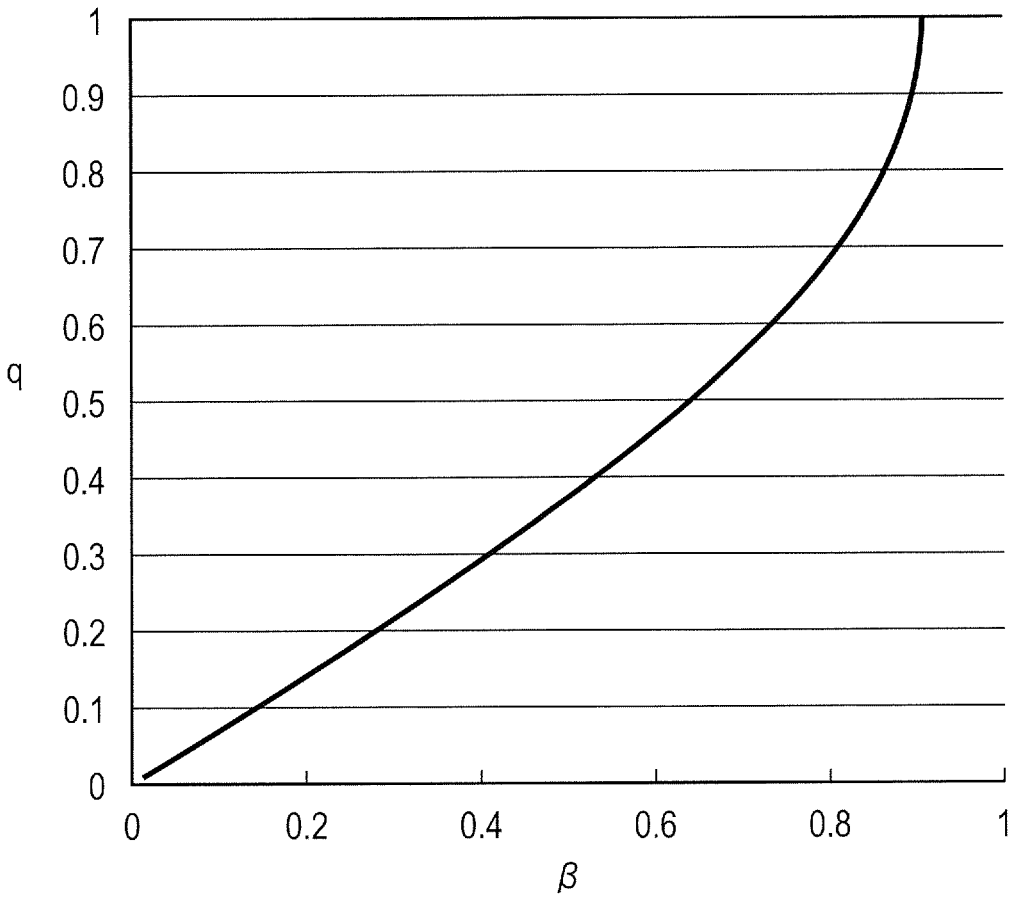
FIG. 3 is a relationship diagram for the q and the β.

Further, ω can be calculated from the time t from the start of the scan at each point on the mass spectrum, β can be calculated in the relation of (formula 2) from ω, and the q value can be calculated from the relation in FIG. 3 from β. Setting the q value of the ion at data point i on the pre-correction mass spectrum as q'i, yields a q value (qi) corrected for the shift Δqi in the q value occurring due to the space charge for the ion at data point i that is expressed as follows.

$$q_i = q'_i \quad \text{[Formula 7]}$$

Substituting this qi into (formula 1) allows calculating the m/z of the ion at data point i where the effect from the space charge was corrected. Repeating this operation at each data point allows correcting the entire mass spectrum. Moreover, just the designated peaks on the mass spectrum can be corrected as well as the entire mass spectrum.

The method of the present invention is particularly essential for correcting effects from the space charge in analysis after measurement, because large variations appear in each scan of the counts of ions introduced to the ion trap when introducing samples and ions discontinuously into the mass spectrometer as in this embodiment.

The mass spectrum corrected for effects from the space charge is displayed on the display part 60. By averaging the mass spectrums each corrected for effects from space charge after carrying out multiple mass scans, a high S/N (signal-to-noise) ratio can be obtained from the mass spectrum measured in one scan, even when there are large variations appearing in each scan of the counts of ions introduced to the ion trap.

Second Embodiment

Discharge from the Isolation Process

Figure 8:
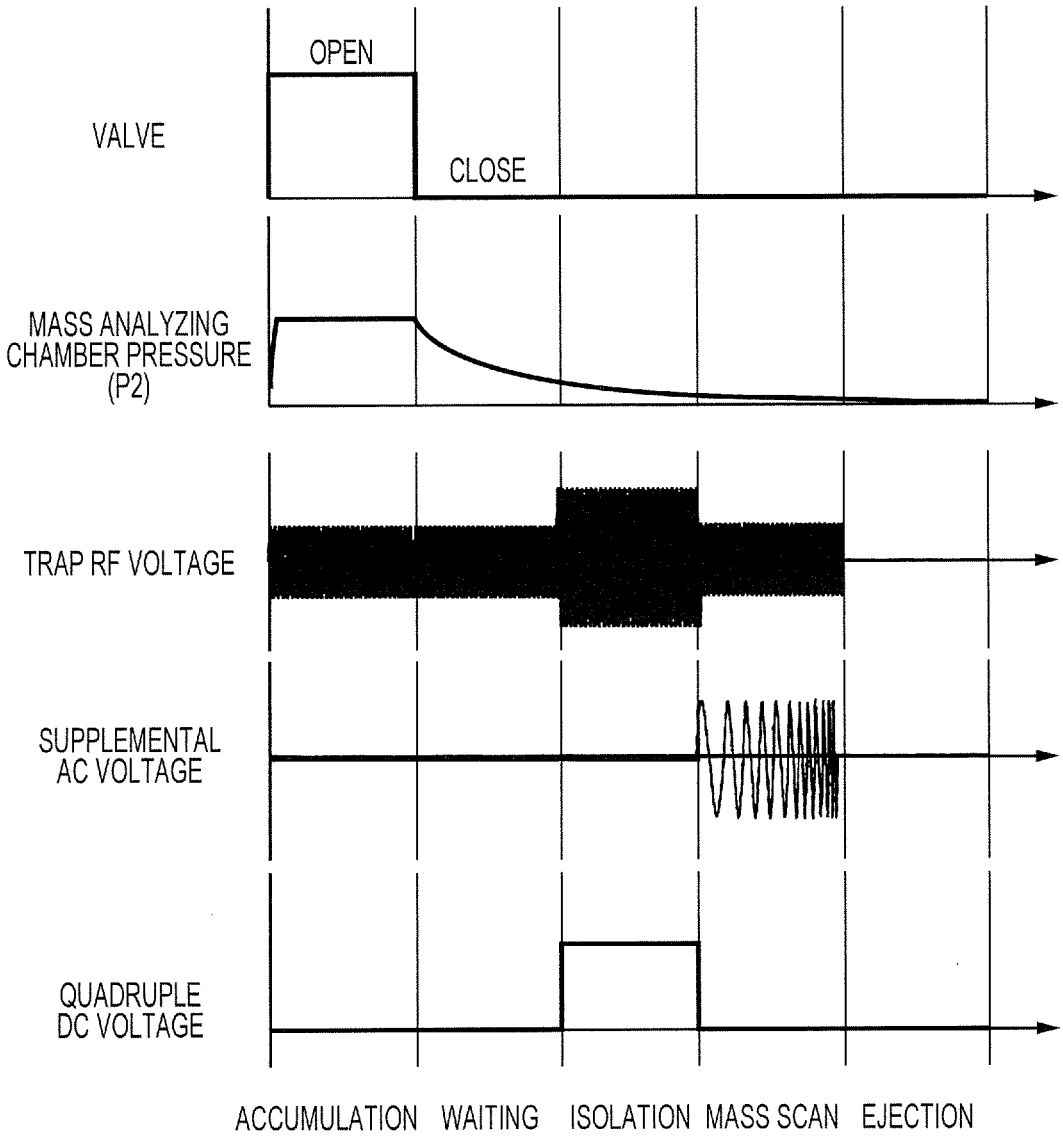
FIG. 8 is a graph showing the measurement sequence.

The device structure is identical to the first embodiment. The measurement sequence is shown in FIG. 8. The difference versus the first embodiment is that there is a isolation process between the waiting process and the mass scan process. The isolation process is approximately 1 ms to 100 ms.

Figure 9:
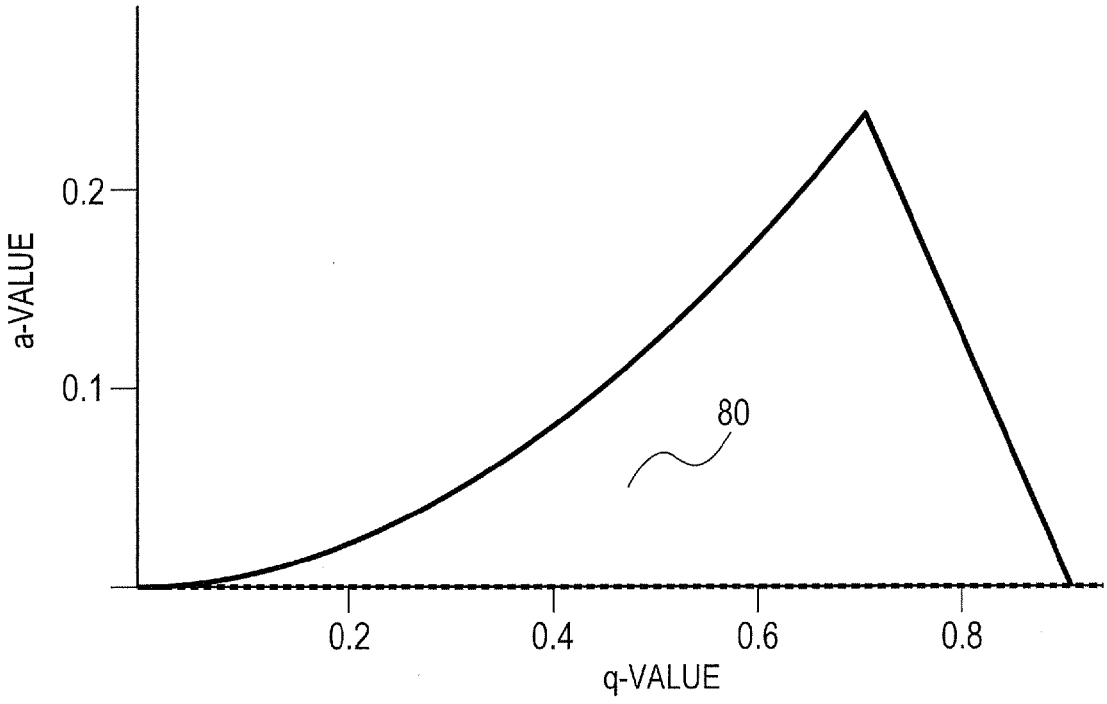
FIG. 9 is a relationship diagram for the a value and the q value.

In this isolation process a quadrupole DC voltage is applied so as to attain an inverse phase between adjacent rods, and to attain the same phase between opposite facing rods (between 7*a*, 7*b*, and between 7*c*, 7*d*) in the quadrupole rod electrodes 7. At this time only ions within the stable region 80 remain within the ion trap, and the other ions are extracted. The a and q in FIG. 9 are values applied in the following formula.

$$q = \frac{4eV}{mr_0^2\Omega^2} \quad \text{[Formula 8]}$$

$$a = \frac{8eU}{mr_0^2\Omega^2} \quad \text{[Formula 9]}$$

Here, U denotes the quadrupole DC voltage (V). The trap RF voltage amplitude and the quadrupole DC voltage intensity are set so that only ions in the m/z range scanned in the mass scan process remain in the trap. Effects from space charge on ions outside the mass spectrum measurement range can be avoided so that more robust corrections can be made compared to the first embodiment.

By adjusting the time for the waiting process and setting the mass analyzing chamber pressure within 1 Pa or lower in the isolation process, the loss of ions within the stable region can be suppressed and ions outside the stable region can be extracted. Ions outside the stable region can be extracted even if a quadrupole DC voltage is applied in the waiting process and accumulation process, but in that case a loss of ions will occur within the stable region.

Even if a waveform overlapped with the resonant frequency of ions outside the m/z region scanned in the mass scan period is applied as an supplemental AC voltage, without applying a quadrupole DC voltage in the isolation process, the ions outside the m/z range for scanning in the mass scan process can be extracted and robust correction can be achieved.

Third Embodiment

When Sweeping the Trap RF Voltage

Figure 10:
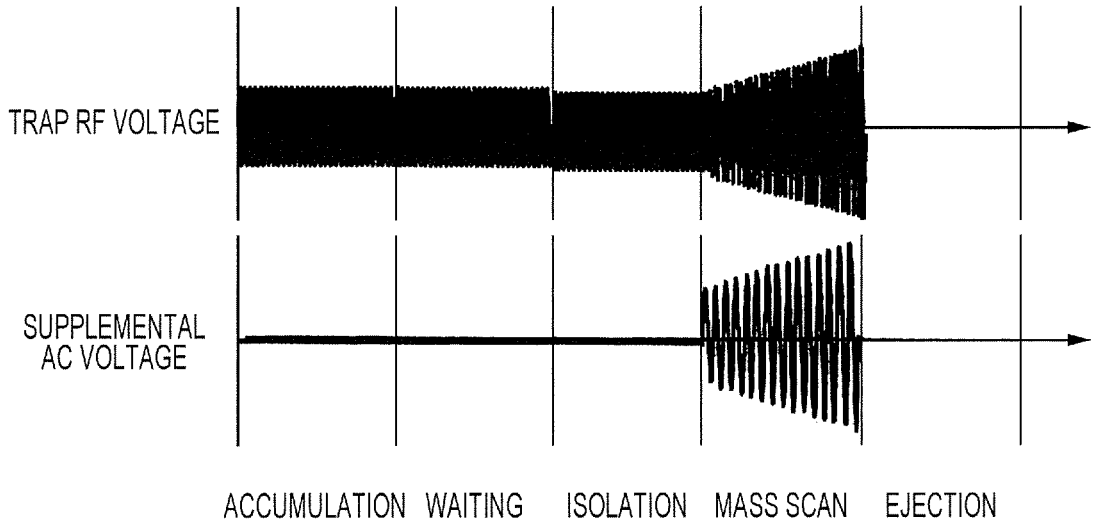
FIG. 10 is a drawing showing the measurement sequence.

The device structure and voltages other than the supplemental AC voltage and trap RF voltage amplitude are the same as the first embodiment. FIG. 10 shows the measurement sequence for the supplemental AC voltage and trap RF voltage. In this embodiment, the supplemental AC voltage is maintained at a specified frequency and the trap RF voltage amplitude is scanned. The supplemental AC voltage amplitude may be a fixed value; however, the ions can be extracted at a higher efficiency by scanning the supplemental AC voltage so as to be in proportion to trap RF voltage amplitude as shown in FIG. 10. Scanning the trap RF voltage amplitude from low to high in the relation of (formula 1) scans the m/z of the resonant-excited ions from low mass to high mass. When scanning the trap RF voltage amplitude, the effect of a shallower pseudopotential well from the space charge can be written as the following formula.

$$D + \Delta D = (V + \Delta V)\frac{q}{4} \quad \text{[Formula 10]}$$

Setting the trapped charge quantity as Si at the point in time that ions i are extracted yields a shift ΔV in the trap RF voltage amplitude due to the space charge as shown below.

$$\Delta V_i = \frac{C'}{q} S_i \quad \text{[Formula 11]}$$

Here, C' denotes the experientially established constant that is dependent on the shape of the ion trap, and is stored within the data processing part or in the storage part.

Figure 11:
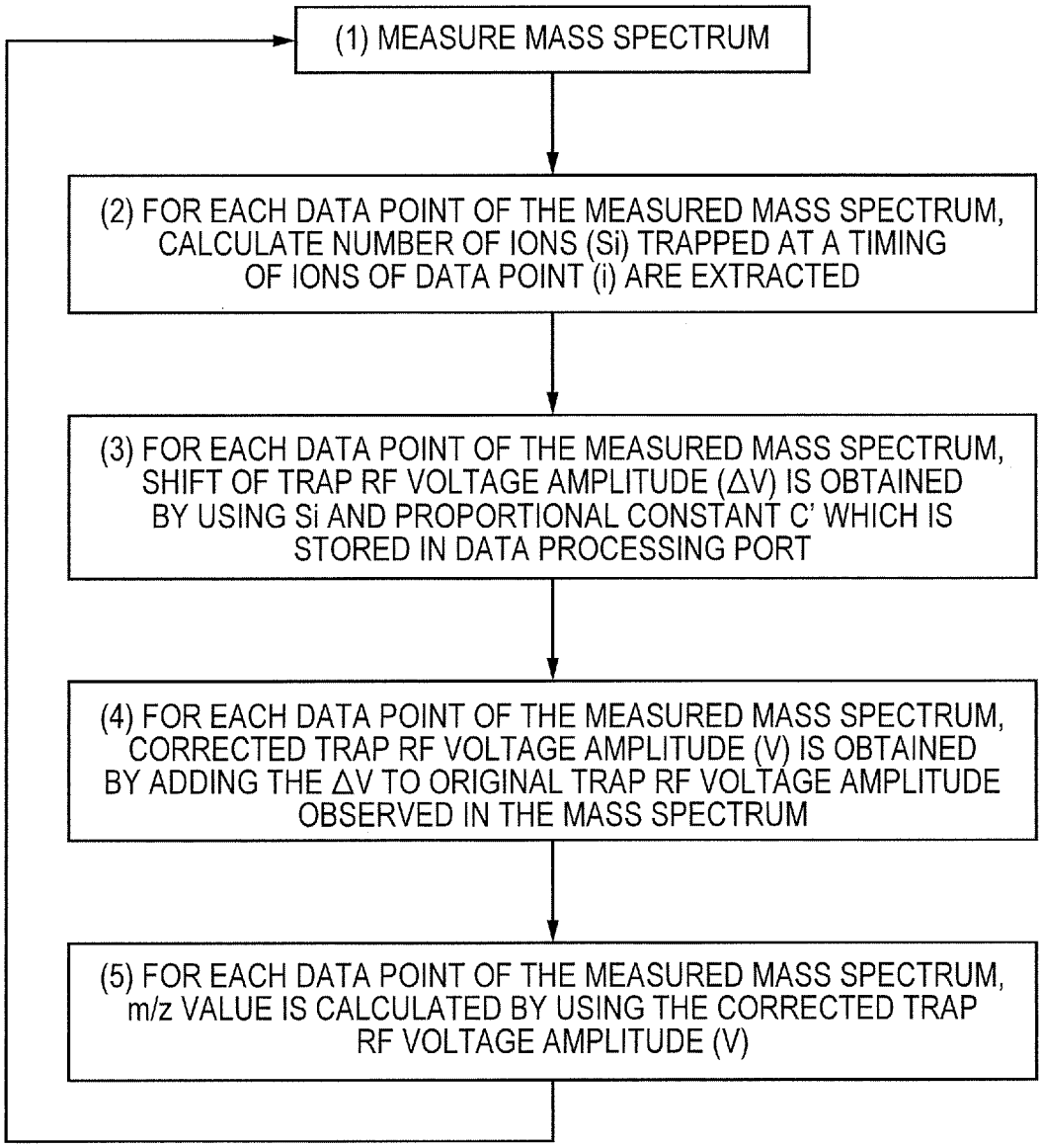
FIG. 11 is a flowchart for showing the specific method of the present invention.

The actual method of the present invention is described next utilizing the flowchart in FIG. 11. The Si is first of all calculated by the same method as in the first embodiment. Next, the shift ΔV in the trap RF voltage amplitude is calculated by the space charge from the relation of formula 11. The trap RF voltage amplitude Vi whose shift due to the space charge was corrected is calculated by utilizing the shift ΔV. Setting the trap RF voltage amplitude to V'i at the data point i on the mass spectrum prior to correction yields a trap RF voltage amplitude Vi whose shift due to the space charge was corrected by the space charge as follows.

$$V_i = V'_i + \Delta V_i \quad \text{[Formula 12]}$$

Finally, substituting this Vi into (formula 1) allows calculating the m/z of the ion at the data point i where the effect from the space charge was corrected.

A large RE voltage amplitude is required for measuring the mass spectrum in the same m/z range so more electrical power is introduced from the power source compared to the first embodiment. However a high mass resolution can be obtained for ions with a high mass compared to the method of the first embodiment.

Fourth Embodiment

Fine Corrections of the Mass Spectrum

The effect applied by the space charge on movement of each extracted ion will strictly speaking differ according to the m/z of each ion. In this embodiment, a method is described for correct effects from the space charge more accurately than in the first embodiment by utilizing a weighted value in which the effect from the space charge given to the ion for correcting by each ion is applied to the signal intensity of each trapped ion at the point in time that the ion for correcting was extracted. The device structure and the measurement sequence are identical to the first embodiment.

The Δqi can be calculated as follows when correcting ions the data point i by multiplying a weighted C of the space charge effect applied by each data point ion to the data point i ions, per the ion signal intensity I of trapped ions at each data point at the point in time the data point i ions are extracted.

$$\Delta q_i = \sum_{j=i}^{n} \frac{C(j)}{V} I_j \quad \text{[Formula 13]}$$

Here, n denotes the final data point on the mass spectrum. The weighted C(j) for the space charge is stored in advance in the storage part or the data processing part.

Figure 12:
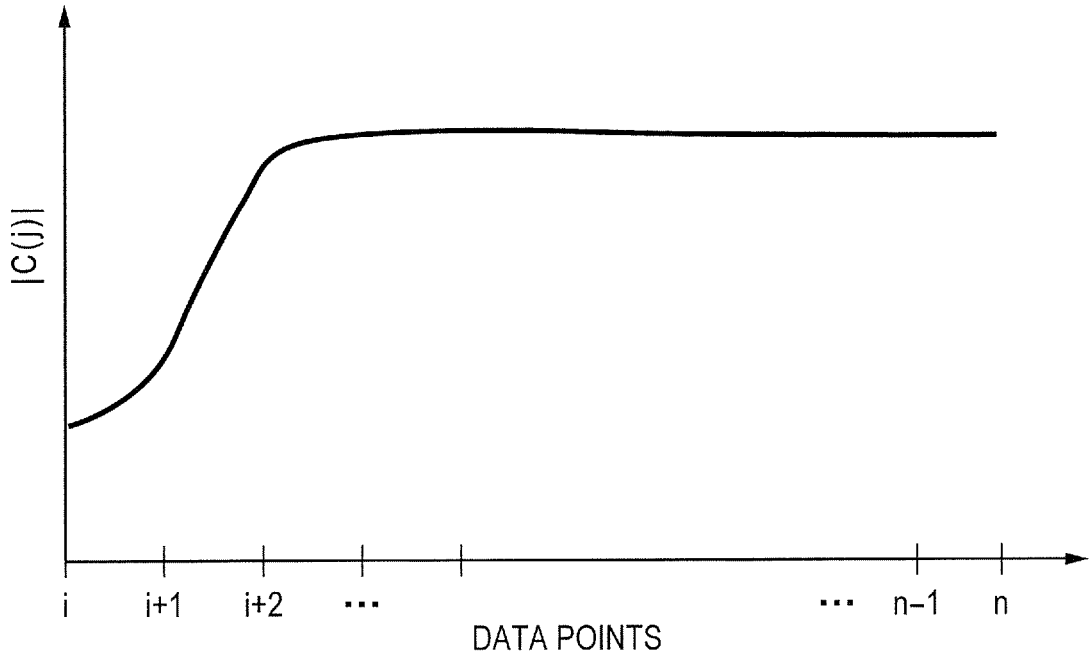
FIG. 12 is a graph showing an example of C (j)

FIG. 12 shows one example of C(j). The ion at the data point for correction, or in other words ions whose m/z is near the resonant-excited ions generally have a small |C(j)|. The reason is that the resonant-excited ions and ions near the m/z have a position distribution that widens along the radius of the ion trap and so the effect applied to the ion is small compared to the ions trapped on the central axis. The method in the fourth embodiment is capable of making corrections more accurately than the first embodiment, however the calculations are complicated and moreover a memory is required for storing the function C(j) in the storage part.

Fifth Embodiment

Applications to Tandem Mass Spectrometry Measurement

The device structure is identical to the first embodiment. A list of information such as the m/z of the ion for measurement, threshold value of the ion signal intensity, whether or not tandem mass spectrometry measurement is needed, the m/z of the precursor ion for tandem mass spectrometry measurement, and the fragment ion threshold value for ion signal intensity are stored in the storage part. An example of this list is shown in FIG. 14. The list in FIG. 14 shows information (threshold value, m/z of ion for measurement, etc.) required for identification and quantification of the substance for each measurement object, and measurements are made based on that information.

Figure 13:
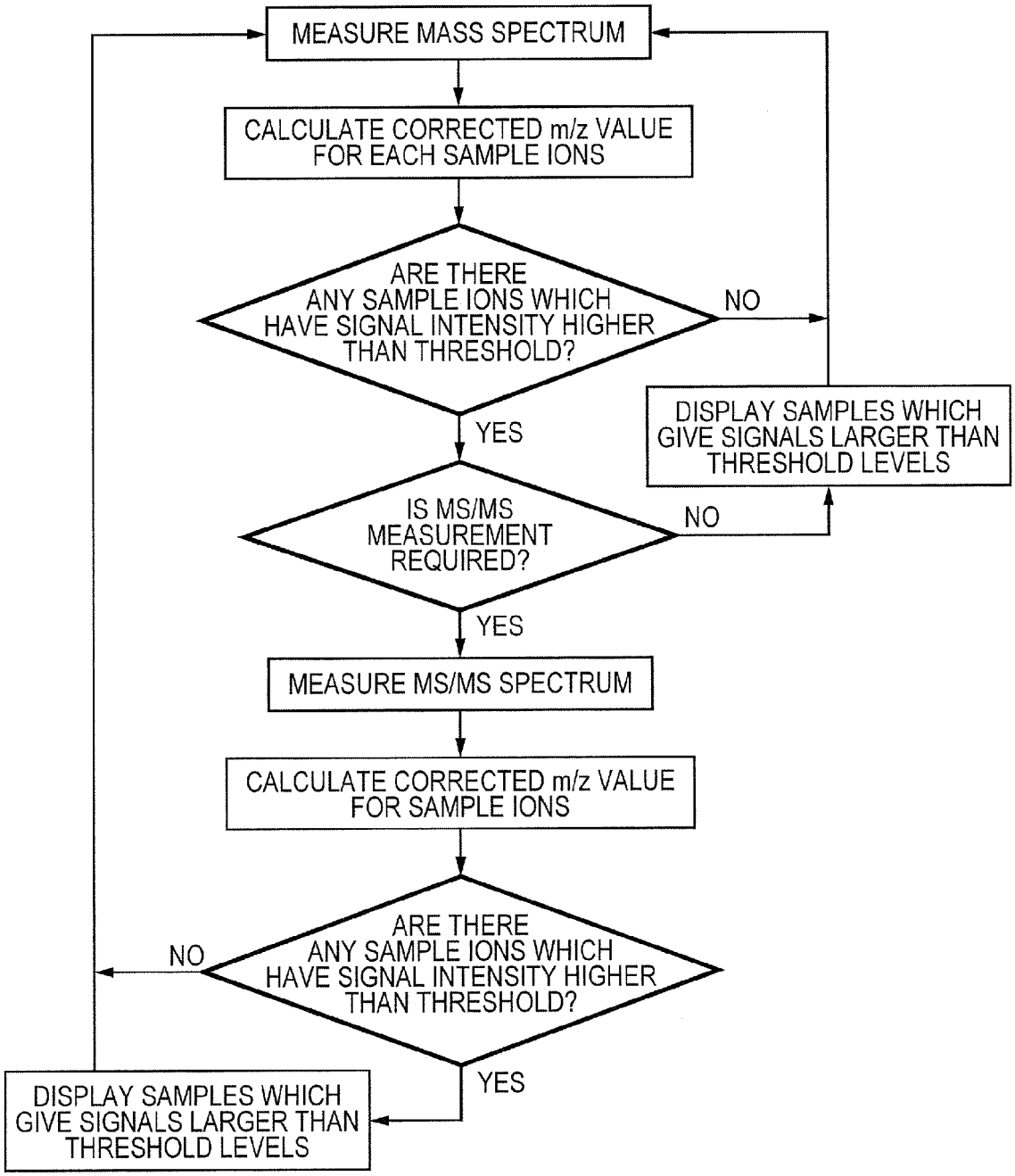
FIG. 13 is a flowchart for showing the measurement flow.

FIG. 13 shows the measurement flow by using a flowchart. The mass spectrum is first of all measured. The measured mass spectrum is corrected using the method of the first embodiment. The time for calculating the correction can be shortened at this time, by correcting only the specified m/z range including the m/z of the ion for measurement, and typically the peak for the approximate m/z range stored in the list to m/z 0.1 to 2 amu, while referring to the list stored in the storage part.

A judgment is next made on whether the signal intensity of the ion for measurement exceeded the threshold value relative to the peak that was corrected. If there is no measured ion that exceeded the threshold value then the operation returns to measuring the mass spectrum. However if there is a measured ion that exceeded the threshold value then a judgment is made on whether the tandem mass spectrometry measurement is required from information in the list. When a tandem mass spectrometry measurement is not required then the results are shown on the display part 60 and the operation returns to acquiring the mass spectrum. When tandem mass spectrometry measurement is required then this tandem mass spectrometry measurement is continuously performed. Corrections are made to the tandem mass spectrum acquired by the tandem mass spectrometry measurement. Next, while referring to the list, a judgment is made on whether the signal intensity of the ion for measurement exceeded the threshold value. If there are measured ions that exceeded the threshold value then a display is shown on the display part 60 and the operation returns to measuring the next mass spectrum. The flow of this flowchart is repeated until the measurement is complete.

Figure 15:
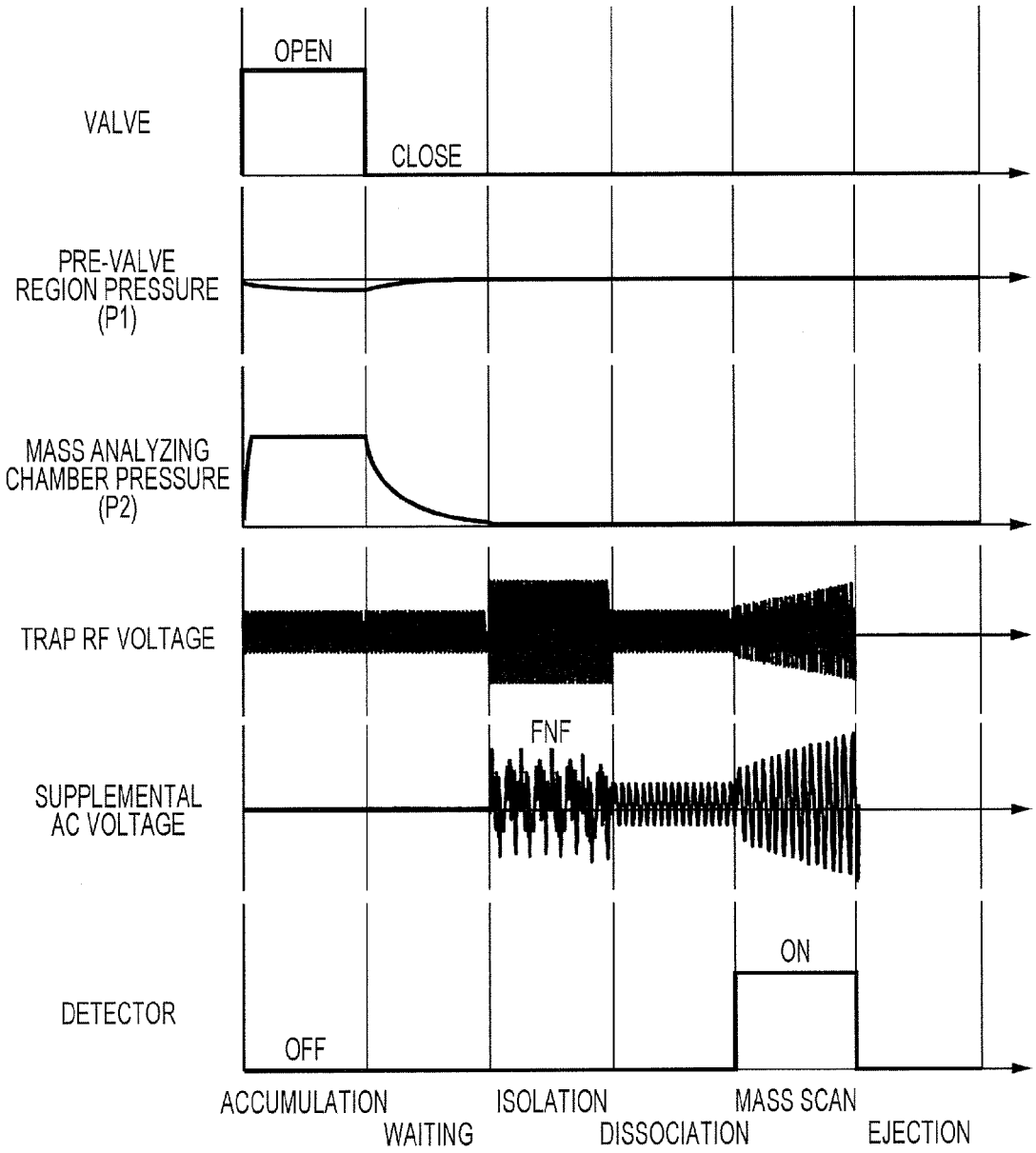
FIG. 15 is a drawing showing the measurement sequence.

FIG. 15 shows the measurement sequence during the tandem mass spectrometry measurement. Aside from the isolation process and the dissociation process, the sequence is the same as in FIG. 2. In the isolation process, the supplemental AC voltage is applied to overlapped resonant frequencies of other than precursor ions to exclude ions other than precursor ions. In the dissociation process, the supplemental AC voltage is applied to the resonant frequency of the precursor ions, and the precursor ions are dissociated by colliding with neutral molecules in the ion trap to generate fragment ions. The dissociation method is not limited to the above technique and may for example employ electron capture dissociation, electron transfer dissociation, or photo-excitation to perform dissociation.

During tandem mass spectrometry measurement, the length of the accumulation time may be adjusted from the precursor ion signal quantity of the just prior measured mass spectrum. If the precursor ion signal quantity of the just prior measured mass spectrum is not small then the duty cycle can be maintained by lengthening the accumulation time, and a high S/N (signal-to-noise) ratio obtained if the precursor ion counts is comparatively small.

Also, substituting the precursor ion signal quantity of the just prior measured mass spectrum into (Formula 4) allows knowing the shift in the q value, and the resonant frequency including the shift due to the space charge can be calculated from this shift in q value. By applying a resonant frequency including a shift from the spatial change, this dissociation process can dissociate the precursor ions with high efficiency.

Sixth Embodiment

Figure 16:
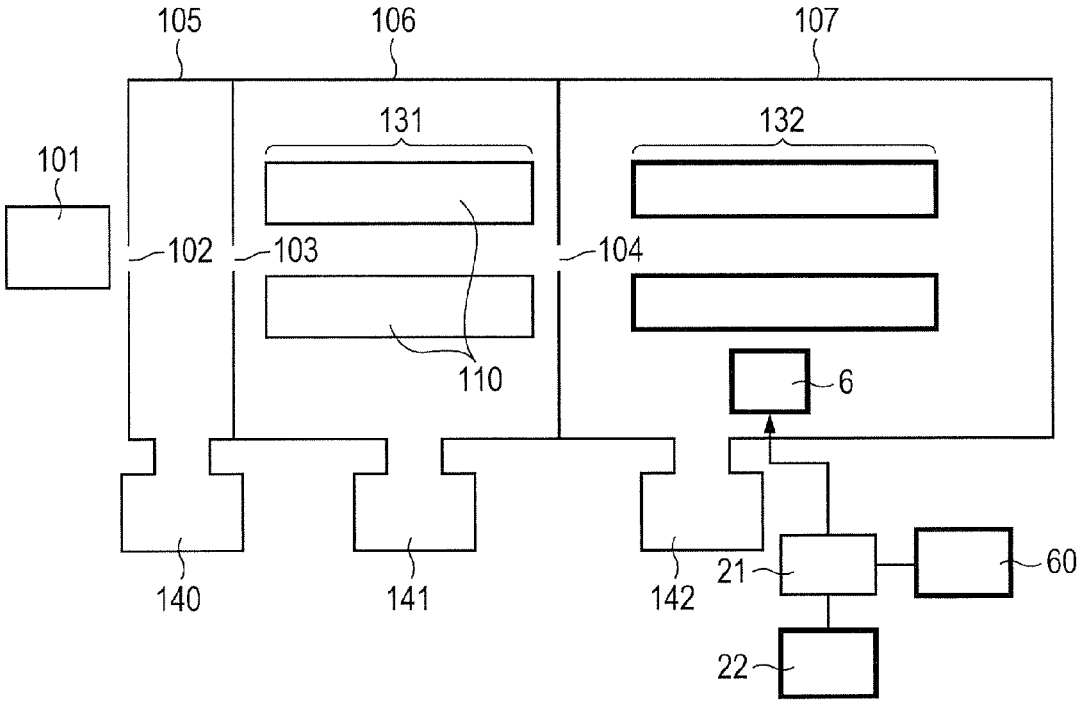
FIG. 16 is a drawing showing an example of the mass spectrometer.

FIG. 16 is a drawing showing another embodiment of the mass spectrometer. Loading or input mechanisms such as for the buffer gas were omitted for purposes of simplicity. Ions generated in an ion source 101 such as an electrospray ion source, an atmospheric pressure chemical ion source, an atmospheric pressure photoionization source, an atmospheric matrix support laser dissociation ion source, and a matrix support laser dissociation ion source, are introduced via the first orifice 102 to a first differential pumping part 105. A pump 140 exhausts the first differential pumping part 105. The ions introduced into the first differential pumping part 105, are introduced via the second orifice 103 into a second differential pumping part 106. A pump 141 exhausts the second differential pumping part 106 to maintain the pressure at approximately $10^{-4}$ Torr to $10^{-2}$ Torr ($1.3\times10^{-2}$ Pa to 1.3 Pa). An ion guide 131 is mounted in the second differential pumping part 106. The ion guide 131 contains a quadrupole rod electrode 110. An RF voltage is generated in the RF power supply and applied in an alternately inverting phase to the quadrupole rod electrode 110. This RF voltage is typically a voltage amplitude from several hundred to 5000 volts, and a frequency of 500 kHz to 2 MHz. A quadrupole DC voltage can be applied to the quadrupole rod electrode 110 of the ion guide so that only ions in the m/z range for scanning by the mass spectrum can pass through the ion guide and are introduced into the ion trap.

The ions from the second differential pumping part 106 are introduced via the third orifice 104 into the high vacuum chamber 107. A pump 142 exhausts the high vacuum chamber 107 to maintain a pressure below $10^{-4}$ Torr. A linear ion trap 132 and a detector 6 are mounted in the high vacuum chamber 107. The structure of the linear ion trap is identical to that in the first embodiment. The structure of the control part 21 and the display part 60 are also identical to the other embodiments. Examples of the linear ion trap were described in the first through the sixth embodiments but any ion trap capable of selectively discharging ions from the ion trap and measuring the mass spectrum such as a three-dimensional quadrupole ion trap or a toroidal ion trap is applicable to the present invention.

The measurement sequence for the trap RF voltage amplitude, and the supplemental AC voltage amplitude is identical to the second embodiment, etc. However, the gas is continuously introduced into the ion trap in this embodiment so the pressure in the high vacuum chamber and within the ion trap is a fixed pressure. An waiting time from approximately 1 to 10 ms is therefore typically a sufficient time for the trapped ions to cool.

The method for correcting the measured mass spectrum is the same as in the other embodiments. This method can also control the counts of ions introduced during measurement of the next mass spectrum by information on the total ion counts of the mass spectrum that was introduced as feedback. This method can further expand the dynamic range.

Though common to the first through the sixth embodiments, the method allows setting the constant C or the function C(j) utilized for the correction to selectively vary the counts of ions introduced into the ion trap by changing the length of the trap accumulation time and the length of the ion source operation time for ions of the m/z of the related art and to measure the mass spectrum under the respective conditions.

What is claimed is:

1. A mass spectrometry method comprising:

ionizing a sample with an ion source;

accumulating the ions in an ion trap; and acquiring the mass spectrum by ejecting ions selectively by mass from the ion trap and detecting the ions by a detector, wherein the mass axis of the mass spectrum is corrected based on the counts of ions accumulated within the ion trap at the point in time that each ion was extracted.

2. The mass spectrometry method according to claim 1, wherein a valve to discontinuously introduce ions into the ion trap is provided so that the opening and closing of the valve discontinuously introduces the ions into the ion trap.

3. The mass spectrometry method according to claim 1, comprising the step of:

ejecting a portion of the ions within the ion trap, between the steps of accumulating the ions and acquiring the mass spectrum.

4. The mass spectrometry method according to claim 1, wherein an alternating current voltage is applied to the ion trap to resonance-excite and eject ions selected by mass in the step of acquiring the mass spectrum.

5. The mass spectrometry method according to claim 4, wherein the frequency of the alternating current voltage to resonance-excite the ions is scanned in the step of acquiring the mass spectrum.

6. The mass spectrometry method according to claim 4, wherein by utilizing an alternating current voltage that forms the potential to trap the ions in the ion trap, the amplitude of the alternating current voltage that forms the potential to trap ions is scanned in the process for acquiring the mass spectrum.

7. The mass spectrometry method according to claim 1, wherein the mass axis of the mass spectrum is corrected utilizing the signal intensity of each ion accumulated in the ion trap at the point in time the ion for correction was extracted, with a value weighted for the space charge effect each ion exerts on the ion for correction.

8. The mass spectrometry method according to claim 1, wherein a control part storing a list including information on the mass of the precursor ions is provided so that the presence or absence of a precursor ions in the list is judged from the corrected mass spectrum based on the ions accumulated in the ion trap at the point in time each ion was extracted, and tandem mass spectrometry measurement is performed.

* * * * *